US010451297B2

(12) United States Patent
Henderson

(10) Patent No.: US 10,451,297 B2
(45) Date of Patent: Oct. 22, 2019

(54) AIR CONDITIONING SYSTEM INCLUDING A REHEAT LOOP

(71) Applicant: Haier US Appliance Solutions, Inc., Wilmington, DE (US)

(72) Inventor: Richard Dustin Henderson, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 39 days.

(21) Appl. No.: 15/582,893

(22) Filed: May 1, 2017

(65) Prior Publication Data

US 2018/0313555 A1 Nov. 1, 2018

(51) Int. Cl.
*F24F 3/153* (2006.01)
*F24F 3/14* (2006.01)
*F24F 11/00* (2018.01)

(52) U.S. Cl.
CPC ..... *F24F 3/153* (2013.01); *F24F 3/1405* (2013.01); *F24F 11/0008* (2013.01)

(58) Field of Classification Search
CPC ..... F24F 3/153; F24F 3/1405
USPC ..... 62/531
See application file for complete search history.

(56) References Cited

U.S. PATENT DOCUMENTS 5,231,845 A * 8/1993 Sumitani ..... F24F 3/153 165/240
5,305,822 A * 4/1994 Kogetsu ..... F24F 3/1405 165/225
5,345,776 A * 9/1994 Komazaki ..... F24F 3/14 62/176.3
6,012,296 A * 1/2000 Shah ..... F24F 11/0008 62/173
6,904,767 B1 6/2005 Wright
7,114,345 B2 * 10/2006 Kim ..... F25D 23/003 62/296
7,165,414 B2 1/2007 Wright
7,845,185 B2 12/2010 Knight et al.
2006/0107685 A1 * 5/2006 Lifson ..... F24F 3/153 62/428

(Continued)

FOREIGN PATENT DOCUMENTS

CN 1232772 C 12/2005
CN 101149168 B 5/2010

(Continued)

*Primary Examiner* — Henry T Crenshaw
(74) *Attorney, Agent, or Firm* — Dority & Manning, P.A.

(57) ABSTRACT

An air conditioning system and a method of operating the same to dehumidify air from an indoor space without overly cooling that air is provided. The air conditioning system includes an outdoor heat exchanger, an indoor heat exchanger, and a reheat heat exchanger. Indoor air passes through the indoor heat exchanger where it is dehumidified before passing through the reheat heat exchanger where it is reheated using thermal energy from a refrigerant. An outdoor fan urges a flow of ambient air through the outdoor heat exchanger to extract thermal energy from the refrigerant before it passes to the reheat heat exchanger. The speed of the outdoor fan is adjusted to control an amount of thermal energy extracted from a refrigerant passing through the outdoor heat exchanger and thus the thermal energy supplied to the reheat heat exchanger for reheating the dehumidified air to a target temperature.

18 Claims, 2 Drawing Sheets

(56) References Cited

U.S. PATENT DOCUMENTS

| | | | | |
|---|---|---|---|---|
| 2006/0130499 | A1* | 6/2006 | Hong | B60H 1/3211 62/176.6 |
| 2011/0100035 | A1* | 5/2011 | Taras | F24F 3/153 62/90 |
| 2011/0113800 | A1* | 5/2011 | Sekiya | B60H 1/00278 62/151 |
| 2011/0173999 | A1* | 7/2011 | Lord | F24F 3/048 62/89 |
| 2012/0037352 | A1* | 2/2012 | Osaka | B60H 1/00021 165/202 |
| 2013/0014522 | A1* | 1/2013 | Lukasse | F25D 17/042 62/93 |
| 2013/0299129 | A1* | 11/2013 | Osaka | B60H 1/0005 165/59 |
| 2017/0343232 | A1* | 11/2017 | Price | F24F 5/0046 |

FOREIGN PATENT DOCUMENTS

| | | | |
|---|---|---|---|
| JP | 2003106706 | A | 4/2003 |
| JP | 2004012111 | A | 1/2004 |
| JP | 2005201489 | A | 7/2005 |
| JP | 4389430 | B2 | 12/2009 |

* cited by examiner

AIR CONDITIONING SYSTEM INCLUDING A REHEAT LOOP

FIELD OF THE INVENTION

The present disclosure relates generally to air conditioning systems, and more particularly to air conditioners having reheat loops.

BACKGROUND OF THE INVENTION

Air conditioning systems are conventionally utilized to condition air within an indoor space—i.e., to adjust the temperature and humidity of the air within structures such as dwellings and office buildings. Such systems commonly include a closed refrigeration loop to condition the indoor air which is recirculated while being heated or cooled. Certain refrigeration loops include an outdoor heat exchanger positioned outdoors, an indoor heat exchanger positioned indoors, and tubing or conduit for circulating a flow of refrigerant through the heat exchangers to facilitate heat transfer.

When the air within the indoor space is humid, it may be desirable to remove moisture from the air. Air conditioning systems typically dehumidify air by passing the humid air over an indoor heat exchanger that has cool refrigerant passing through its coils. As the humid air passes through the indoor heat exchanger and crosses over its refrigerant cooled coils, the coils pull moisture from the air by lowering the temperature of the air and causing moisture in the air to condense on the coils. The dehumidified air is then passed into the indoor space at a lower temperature and humidity.

However, in certain situations, such as when it is cool and humid outside, such a dehumidification process may lower the temperature of indoor air below the target temperature of the indoor space. Certain air conditioning systems use electric heaters to heat the indoor air downstream of the indoor heat exchanger. However, such electric heaters are costly and decrease the energy efficiency of the air conditioning system.

Accordingly, improved air conditioning systems with features for removing humidity from indoor air without cooling the air below the target indoor temperature would be useful.

BRIEF DESCRIPTION OF THE INVENTION

The present subject matter provides an air conditioning system and a method of operating the same to dehumidify air from an indoor space without overly cooling that air. The air conditioning system includes an outdoor heat exchanger, an indoor heat exchanger, and a reheat heat exchanger. Indoor air passes through the indoor heat exchanger where it is dehumidified before passing through the reheat heat exchanger where it is reheated using thermal energy from a refrigerant. An outdoor fan urges a flow of ambient air through the outdoor heat exchanger to extract thermal energy from a refrigerant before it passes to the reheat heat exchanger. The speed of the outdoor fan is adjusted to control an amount of thermal energy extracted from the refrigerant passing through the outdoor heat exchanger and thus the thermal energy supplied to the reheat heat exchanger for reheating the dehumidified air to a target temperature. Additional aspects and advantages of the invention will be set forth in part in the following description, may be obvious from the description, or may be learned through practice of the invention.

In accordance with one embodiment, an air conditioning system is provided. The air conditioning system includes a refrigeration loop including an outdoor heat exchanger positioned within an outdoor portion, a reheat heat exchanger positioned within an indoor portion, and an indoor heat exchanger positioned within the indoor portion. A compressor is operably coupled to the refrigeration loop and is configured for urging a flow of refrigerant through the outdoor heat exchanger, the reheat heat exchanger, and the indoor heat exchanger. An outdoor fan urges a flow of air through the outdoor heat exchanger, a temperature sensor positioned within the indoor portion, and a controller is configured for controlling a speed of the outdoor fan in response to a temperature measured by the temperature sensor.

In accordance with another embodiment, a method of operating an air conditioning system is provided. The air conditioning system includes an indoor heat exchanger, a reheat heat exchanger, and an outdoor heat exchanger. The method includes obtaining an indoor temperature using an indoor temperature sensor and selectively operating an outdoor fan to control an amount of thermal energy extracted from a refrigerant passing through the outdoor heat exchanger and adjust the indoor temperature to a target temperature.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
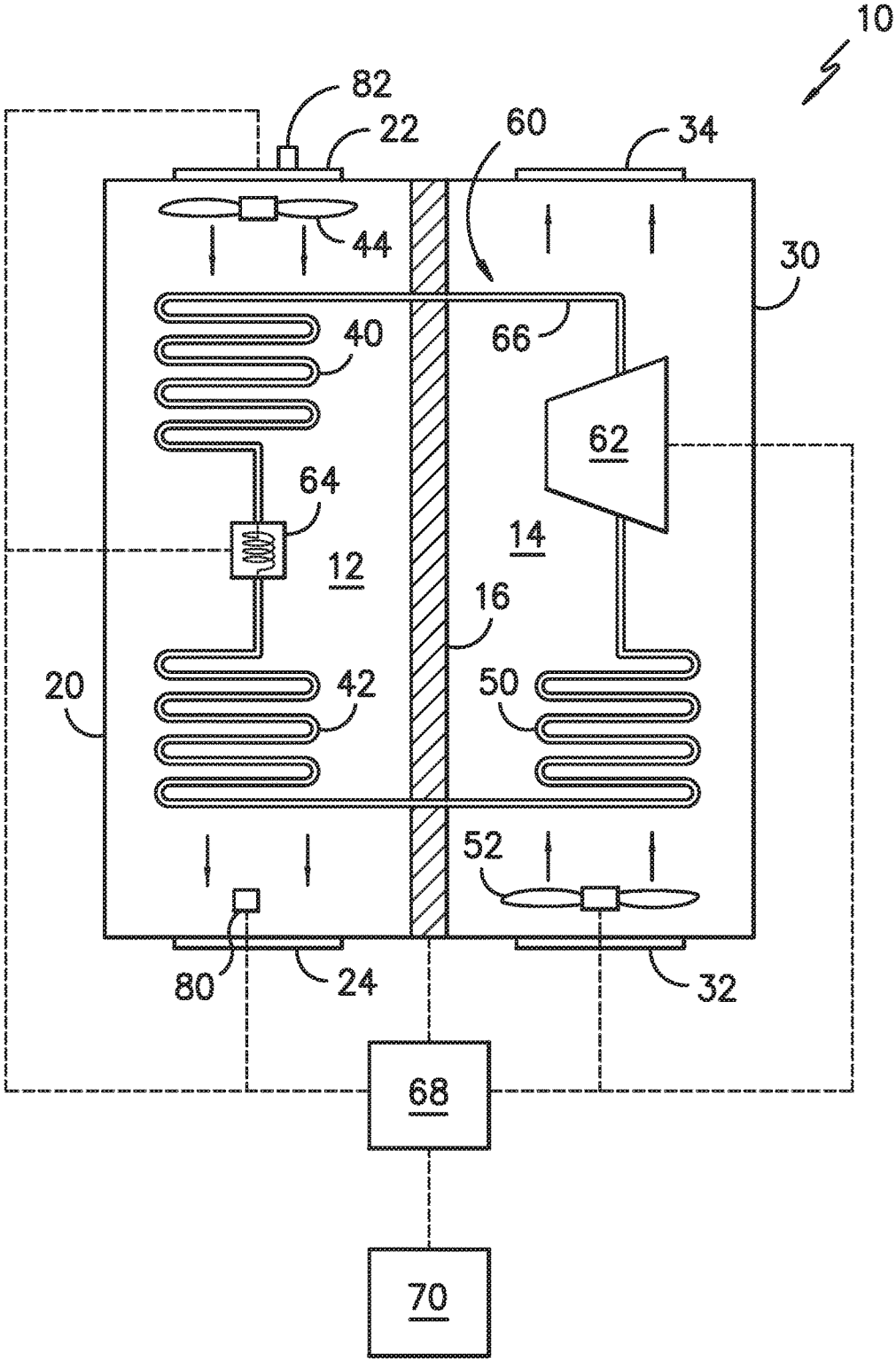
FIG. 1 provides a schematic view of an air conditioning system in accordance with one exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to FIG. 1, an air conditioning system 10 is provided. The system 10 includes an indoor portion 12 and an outdoor portion 14 separated by a partition 16, such as a wall. Although indoor portion 12 and outdoor portion 14 are illustrated as being adjacent to each other and separated by partition 16, it should be appreciated that this is only one exemplary embodiment. According to alternative embodiments, indoor portion 12 and outdoor portion 14 may be positioned separate from each other and connected by extended lengths of tubing or conduit.

Indoor portion 12 of air conditioning system 10 may generally define an indoor air duct 20 through which indoor air may be circulated for conditioning. More specifically, indoor air duct 20 may define an indoor return vent 22 for drawing a flow of indoor air into system 10 and an indoor supply vent 24 positioned downstream of indoor return vent 22 for supplying conditioned indoor air back into the room. It should be appreciated that the terms "upstream" and "downstream" refer to the relative direction with respect to fluid flow in a fluid pathway. For example, "upstream" refers to the direction from which the fluid flows, and "downstream" refers to the direction to which the fluid flows.

Similarly, outdoor portion 14 of air conditioning system 10 may generally define an outdoor air duct 30 through which outdoor air may be passed, e.g., for discharging thermal energy to the ambient environment. More specifically, outdoor air duct 30 may define an inlet 32 for drawing a flow of ambient air into system 10 and an outlet 34 positioned downstream of inlet 32 for discharging outdoor air from system 10.

Air conditioning system 10 includes an indoor heat exchanger 40 and a reheat heat exchanger 42 which are positioned within indoor duct 20 between indoor return vent 22 and indoor supply vent 24. In addition, an indoor fan 44 is in fluid communication with indoor duct 20 for urging a flow of air through indoor heat exchanger 40 and reheat heat exchanger 42. In addition, air conditioning system 10 includes an outdoor heat exchanger 50 which is positioned within outdoor duct 30 between inlet 32 and outlet 34. An outdoor fan 52 is in fluid communication with outdoor duct 30 for urging a flow of air through outdoor heat exchanger 50.

Heat exchangers 40, 42, and 50 may be components of a refrigeration loop 60, which is shown schematically in FIG. 1. Refrigeration loop 60 may, for example, further include a compressor 62 and an expansion device 64. As illustrated, compressor 62 and expansion device 64 may be in fluid communication with indoor heat exchanger 40, reheat heat exchanger 42, and outdoor heat exchanger 50 to flow refrigerant through refrigeration loop 60 as is generally understood. More particularly, refrigeration loop 60 may include various lines or conduit 66 for flowing refrigerant between the various components of refrigeration loop 60, thus providing the fluid communication there between.

According to the illustrated embodiment, compressor 62 is in direct fluid communication with the outdoor heat exchanger 50. In this manner, compressor 62 and outdoor heat exchanger 50 are directly connected through a piece of conduit 66 such that no devices or components are positioned between them. In addition, reheat heat exchanger 42 is positioned on refrigeration loop 60 immediately downstream of outdoor heat exchanger 50. As illustrated, expansion device 64 is positioned between reheat heat exchanger 42 and indoor heat exchanger 40. In this manner, refrigerant flows through the connecting conduit 66 from compressor 62 to outdoor heat exchanger 50, from outdoor heat exchanger 50 to reheat heat exchanger 42, from reheat heat exchanger 42 to expansion device 64, from expansion device 64 to indoor heat exchanger 40, and from indoor heat exchanger 40 back into compressor 62. The refrigerant may generally undergo phase changes associated with a refrigeration cycle as it flows to and through these various components, as is generally understood. Suitable refrigerants for use in refrigeration loop 60 may include pentafluoroethane, difluoromethane, or a mixture such as R410a, although it should be understood that the present disclosure is not limited to such example and rather that any suitable refrigerant may be utilized.

As is understood in the art, refrigeration loop 60 may be alternately be operated as a refrigeration assembly (and thus perform a refrigeration cycle) or a heat pump (and thus perform a heat pump cycle). When refrigeration loop 60 is operating in a cooling mode and thus performs a refrigeration cycle, the indoor heat exchanger 40 acts as an evaporator and the outdoor heat exchanger 50 acts as a condenser. Alternatively, when the assembly is operating in a heating mode and thus performs a heat pump cycle, the indoor heat exchanger 40 acts as a condenser and the outdoor heat exchanger 50 acts as an evaporator. The indoor and outdoor heat exchangers 40, 50 may each include coils through which a refrigerant may flow for heat exchange purposes, as is generally understood.

According to an example embodiment, compressor 62 may be a variable speed compressor. In this regard, compressor 62 may be operated at various speeds depending on the current air conditioning needs of the room and the demand from refrigeration loop 60. For example, according to an exemplary embodiment, compressor 62 may be configured to operate at any speed between a minimum speed, e.g., 1500 revolutions per minute (RPM), to a maximum rated speed, e.g., 3500 RPM. Notably, use of variable speed compressor 62 enables efficient operation of refrigeration loop 60 (and thus air conditioning system 10), minimizes unnecessary noise when compressor 62 does not need to operate at full speed, and ensures a comfortable environment within the room.

In exemplary embodiments as illustrated, expansion device 64 may be an electronic expansion valve that enables controlled expansion of refrigerant, as is known in the art. More specifically, electronic expansion device 64 may be configured to precisely control the expansion of the refrigerant to maintain, for example, a desired temperature differential of the refrigerant across the indoor heat exchanger 40. In other words, electronic expansion device 64 throttles the flow of refrigerant based on the reaction of the temperature differential across indoor heat exchanger 40 or the amount of superheat temperature differential, thereby ensuring that the refrigerant is in the gaseous state entering compressor 62. According to alternative embodiments, expansion device 64 may be a capillary tube or another suitable expansion device configured for use in a thermodynamic cycle.

According to the illustrated exemplary embodiment, indoor fan 44 and outdoor fan 52 are illustrated as axial fans. However, it should be appreciated that according to alternative embodiments, indoor fan 44 and outdoor fan 52 may be any suitable fan type. For example, one or both of indoor fan 44 and outdoor fan 52 may be centrifugal fans. In addition, according to an exemplary embodiment, indoor fan 44 and outdoor fan 52 are variable speed fans and may rotate at different rotational speeds to generate different air flow rates. It may be desirable to operate indoor fan 44 and outdoor fan 52 at less than their maximum rated speed to ensure safe and proper operation of refrigeration loop 60 at less than its maximum rated speed, e.g., to reduce noise when full speed operation is not needed.

According to the illustrated embodiment, indoor fan 44 may be positioned upstream of indoor heat exchanger 40 along the flow direction of indoor air and outdoor fan 52 may be positioned upstream of outdoor heat exchanger 50 along the flow direction of outdoor air. Alternatively, indoor fan 44 and outdoor fan 52 may be positioned downstream of indoor heat exchanger 40 and outdoor heat exchanger 50 for urging flows of air through the indoor duct 20 and outdoor duct 30, respectively.

The operation of air conditioning system 10 including compressor 62 (and thus refrigeration loop 60 generally), indoor fan 44, outdoor fan 52, expansion device 64, and other components of refrigeration loop 60 may be controlled by a processing device such as a controller 68. Controller 68 may be in communication (via for example a suitable wired or wireless connection) to such components of the air conditioning system 10. By way of example, the controller 68 may include a memory and one or more processing devices such as microprocessors, CPUs or the like, such as general or special purpose microprocessors operable to execute programming instructions or micro-control code associated with operation of system 10. The memory may represent random access memory such as DRAM, or read only memory such as ROM or FLASH. In one embodiment, the processor executes programming instructions stored in memory. The memory may be a separate component from the processor or may be included onboard within the processor.

System 10 may additionally include a control panel 70 and one or more user inputs, which may be included in control panel 70. The user inputs may be in communication with the controller 68. A user of the system 10 may interact with the user inputs to operate the system 10, and user commands may be transmitted between the user inputs and controller 68 to facilitate operation of the system 10 based on such user commands. A display may additionally be provided in control panel 70, and may be in communication with the controller 68. The display may, for example be a touchscreen or other text-readable display screen, or alternatively may simply be a light that can be activated and deactivated as required to provide an indication of, for example, an event or setting for the system 10.

Air conditioning system 10 may further include one or more sensors used to facilitate operation of system 10. For example, sensors may be used for measuring the temperature, pressure, humidity, or other conditions at any suitable locations within system 10 or in the ambient environment. According to the illustrated embodiment, system 10 includes a temperature sensor 80 positioned within indoor portion 12 or within the room being conditioned. Temperature sensor 80 may be any suitable temperature sensor. For example, temperature sensor 80 may be a thermocouple, a thermistor, or a resistance temperature detector.

As illustrated, temperature sensor 80 is positioned downstream of indoor heat exchanger 40 and reheat heat exchanger 42. More specifically, for example, temperature sensor 80 may be positioned proximate indoor supply vent 24. However, it should be appreciated that according to alternative embodiments, temperature sensor 80 may be positioned at any location suitable for detecting the temperature of dehumidified and reheated air to be supplied to the room. As will be described in detail below, temperature sensor 80 may be used to control the operation of outdoor fan 52 to control the amount of thermal reheat energy passed back into the reheat heat exchanger 42.

In addition, air conditioning system 10 may include one or more humidity sensors 82. In this regard, for example, system 10 can be configured for performing a dehumidification operation when the humidity of the indoor air is above a predetermined threshold. In addition, outdoor fan 52 can be controlled in response to both a humidity measurement by humidity sensor 82 and a temperature measurement by temperature sensor 80. According to the illustrated embodiment, humidity sensor 82 is positioned proximate indoor return vent 22 for measuring the humidity of return air or room air. However, humidity sensor 82 may be positioned in different locations according to alternative embodiments.

It should be appreciated that air conditioning system 10 is described herein only for the purpose of explaining aspects of the present subject matter. For example, air conditioning system 10 is used herein to describe exemplary configurations of refrigeration loop 60, the position and functions of various heat exchangers 40, 42, 50, and the types of sensors 80, 82 used to facilitate control of system 10. It should be appreciated that aspects of the present subject matter may be used to operate air conditioning systems having different types of heat exchangers and various different or additional components. Thus, the exemplary components and methods described herein are used only to illustrate exemplary aspects of the present subject matter and are not intended to limit the scope of the present disclosure in any manner.

Now that the construction and configuration of air conditioning system 10 according to an exemplary embodiment of the present subject matter has been presented, an exemplary method 100 for operating an air conditioning system according to an exemplary embodiment of the present subject matter is provided. Method 100 can be used to operate air conditioning system 10, or any other suitable air conditioning system. In this regard, for example, controller 68 may be configured for implementing method 100. However, it should be appreciated that the exemplary method 100 is discussed herein only to describe exemplary aspects of the present subject matter, and is not intended to be limiting.

Figure 2:
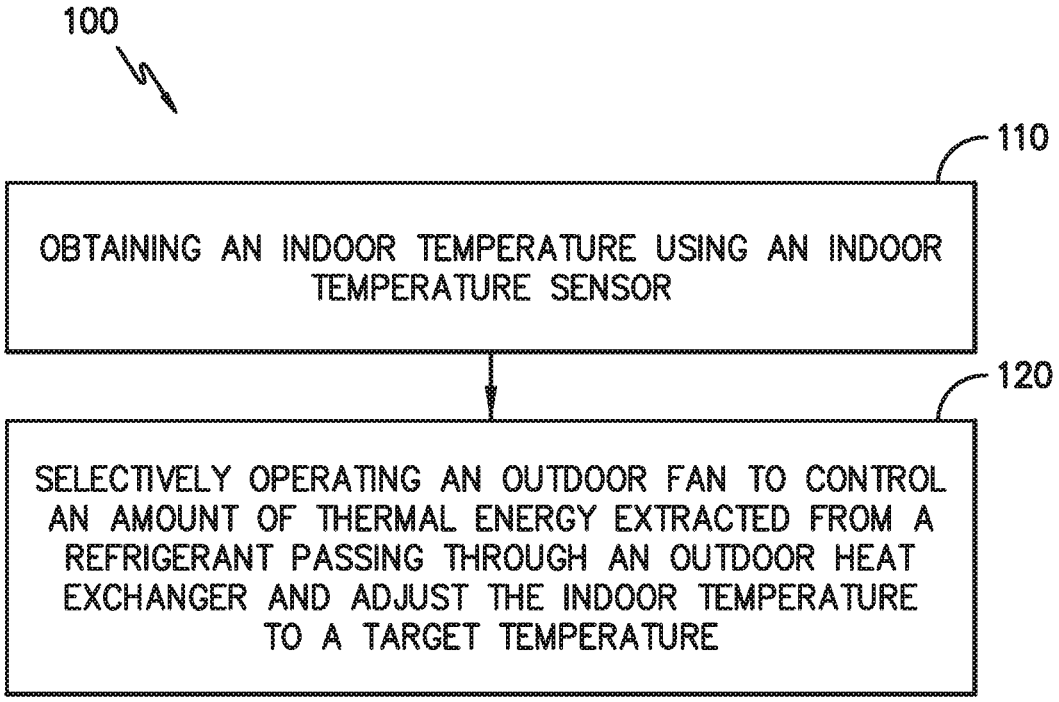
FIG. 2 is a method of operating an air conditioning system in accordance with one embodiment of the present disclosure.

Referring now to FIG. 2, method 100 includes, at step 110, obtaining an indoor temperature using an indoor temperature sensor. For example, using system 10 as an example, the temperature of air supplied into the room may be measured at indoor supply vent 24 by temperature sensor 80. Method 100 further includes, at step 120, selectively operating an outdoor fan to control an amount of thermal energy extracted from a refrigerant passing through the outdoor heat exchanger and adjust the indoor temperature to a target temperature. Thus, for example, outdoor fan 52 may be operated to adjust the amount of thermal energy extracted from refrigerant in outdoor heat exchanger 50, and thus the amount of thermal energy passed to reheat heat exchanger 42 for reheating dehumidified air.

For example, according to one exemplary embodiment, the speed of outdoor fan 52 may be adjusted such that the thermal energy lost by a flow of air passing over indoor heat exchanger 40 is equivalent to the thermal energy gained by the flow of air passing over reheat heat exchanger 42. In this manner, the humidity of air supplied into the room is decreased without also overcooling the air supplied back into the room.

Moreover, outdoor fan 52 may be manipulated in any suitable manner for controlling the amount of thermal energy in refrigerant passing to the indoor portion 12 of air conditioning system 10, e.g., to increase or decrease the temperature of supply air to a target temperature. For example, the speed of outdoor fan 52 may be decreased when the indoor temperature is below the target temperature to allow higher temperature refrigerant to pass through reheat heat exchanger 42. Alternatively, the speed of outdoor fan 52 may be increased when the indoor temperature is above the target temperature to lower the temperature of the refrigerant passing through reheat heat exchanger 42.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioning system comprising:

a refrigeration loop comprising an outdoor heat exchanger positioned within an outdoor portion, a reheat heat exchanger positioned within an indoor portion, and an indoor heat exchanger positioned within the indoor portion;

a compressor operably coupled to the refrigeration loop and being configured for urging a flow of refrigerant through the outdoor heat exchanger, the reheat heat exchanger, and the indoor heat exchanger;

an outdoor fan for urging a flow of air through the outdoor heat exchanger;

a temperature sensor positioned within the indoor portion;

a humidity sensor positioned upstream of the indoor heat exchanger and an indoor return vent; and a controller configured for controlling a speed of the outdoor fan in response to at least one of a temperature measured by the temperature sensor and a humidity measured by the humidity sensor, wherein controlling the speed of the outdoor fan comprises increasing the speed of the outdoor fan when an indoor temperature is above a target temperature to lower a temperature of the flow of refrigerant passing through the reheat heat exchanger.

2. The air conditioning system of claim 1, further comprising:

an indoor air duct defining a return vent and a supply vent positioned downstream of the return vent, wherein the indoor heat exchanger and the reheat heat exchanger are positioned within the indoor air duct between the return vent and the supply vent.

3. The air conditioning system of claim 2, wherein the temperature sensor is positioned downstream of the indoor heat exchanger and the reheat heat exchanger proximate the supply vent.

4. The air conditioning system of claim 2, further comprising:

an indoor fan in fluid communication with the indoor air duct for urging a flow of air through the indoor heat exchanger and the reheat heat exchanger.

5. The air conditioning system of claim 1, wherein the reheat heat exchanger is in direct fluid communication with the outdoor heat exchanger.

6. The air conditioning system of claim 1, wherein the compressor is in direct fluid communication with the outdoor heat exchanger.

7. The air conditioning system of claim 1, wherein the refrigeration loop further comprises:

an expansion device positioned between the indoor heat exchanger and the reheat heat exchanger.

8. A method of operating an air conditioning system, the air conditioning system comprising an indoor heat exchanger, a reheat heat exchanger, and an outdoor heat exchanger, the method comprising:

obtaining an indoor temperature using an indoor temperature sensor;

obtaining an indoor humidity using an indoor humidity sensor positioned upstream of the indoor heat exchanger and an indoor return vent; and selectively operating an outdoor fan to control an amount of thermal energy extracted from a refrigerant passing through the outdoor heat exchanger and adjust the indoor temperature to a target temperature and adjust the indoor humidity to a target humidity, wherein selectively operating the outdoor fan comprises increasing a speed of the outdoor fan when the indoor temperature is above the target temperature to lower the temperature of the refrigerant passing through the reheat heat exchanger.

9. The method of claim 8, wherein selectively operating the outdoor fan comprises:

adjusting the speed of the outdoor fan such that the thermal energy lost by a flow of air passing over the indoor heat exchanger is equivalent to the thermal energy gained by the flow of air passing over the reheat heat exchanger.

10. The method of claim 8, wherein selectively operating the outdoor fan comprises:

decreasing the speed of the outdoor fan when the indoor temperature is below the target temperature to allow higher temperature refrigerant to pass through the reheat heat exchanger.

11. The method of claim 8, wherein the reheat heat exchanger is in direct fluid communication with the outdoor heat exchanger.

12. The method of claim 8, wherein a compressor is in direct fluid communication with the outdoor heat exchanger.

13. The method of claim 8, an expansion device is positioned between the indoor heat exchanger and the reheat heat exchanger.

14. The air conditioning system of claim 1, wherein the humidity sensor is positioned proximate an indoor return vent.

15. The method of claim 8, wherein the humidity sensor is positioned proximate an indoor return vent.

16. The air conditioning system of claim 1, wherein the humidity sensor is positioned upstream of an indoor fan.

17. The method of claim 8, wherein the humidity sensor is positioned upstream of an indoor fan.

18. The air conditioning system of claim 1, wherein the indoor portion defines an indoor air duct that extends between the indoor return vent and an indoor supply vent, the outdoor portion defines an outdoor air duct that extends between an inlet and an outlet, and wherein the indoor portion and the outdoor portion are adjacent to each other and separated by a partition.

* * * * *